US010424168B1

(12) United States Patent
Nottke

(10) Patent No.: US 10,424,168 B1
(45) **Date of Patent: *Sep. 24, 2019**

(54) LIGHTNING VIDEO POKER

(71) Applicant: Timothy G. Nottke, Toledo, OH (US)

(72) Inventor: Timothy G. Nottke, Toledo, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/871,169

(22) Filed: Jan. 15, 2018

Related U.S. Application Data

(63) Continuation-in-part of application No. 14/309,893, filed on Jun. 20, 2014, now Pat. No. 9,870,677.

(60) Provisional application No. 61/837,322, filed on Jun. 20, 2013.

(51) Int. Cl.
*G07F 17/32* (2006.01)

(52) U.S. Cl.
CPC ..... *G07F 17/3293* (2013.01); *G07F 17/3244* (2013.01); *G07F 17/3269* (2013.01)

(58) Field of Classification Search
CPC ..... G07F 17/3293; G07F 17/3244; G07F 17/3269
USPC ..... 463/13
See application file for complete search history.

(56) References Cited

U.S. PATENT DOCUMENTS 5,772,506 A * 6/1998 Marks ..... G07F 17/32 463/13
9,870,677 B1 * 1/2018 Nottke ..... G07F 17/3293
2004/0229672 A1 * 11/2004 Aoki ..... G07F 17/32 463/13
2005/0159199 A1 * 7/2005 Moody ..... A63F 3/00157 463/13
2010/0227667 A1 * 9/2010 Englman ..... G07F 17/3244 463/20
2011/0130192 A1 * 6/2011 Englman ..... G07F 17/32 463/20
2011/0269530 A1 * 11/2011 Jackson ..... G07F 17/3269 463/25

* cited by examiner

*Primary Examiner* — Allen Chan
(74) *Attorney, Agent, or Firm* — Donald K. Wedding

(57) ABSTRACT

A video poker game wherein additional virtual bonus card, called a lightning bonus card, is added to a virtual deck of cards an is randomly dealt into the opening hand of a video poker game. Upon receiving, a randomly dealt lightning bonus card in the opening deal of a video poker game, the player is awarded the opportunity to play as many virtual hands n of video poker during a specific amount of time t without wagering additional credits for each subsequent hand following the receiving of the lightning bonus card. In one embodiment, the lightning bonus card is added to the hand on the deal to replace discarded cards.

8 Claims, 10 Drawing Sheets

LIGHTNING VIDEO POKER

RELATED APPLICATION

This application is a continuation in part under 35 U.S.C. 120 for copending Utility application Ser. No. 14/309,893 filed Jun. 20, 2014 to issue as U.S. Pat. No. 9,870,677 which claims priority under 35 U.S.C. 119(e) for copending Provisional U.S. patent application Ser. No. 61/837,322 filed Jun. 20, 2013 all incorporated herein by reference.

FIELD OF INVENTION

This invention relates to a method for playing video poker wherein an additional virtual bonus card, called a lightning bonus card, is added to a standard deck of virtual cards and upon being dealt into the hand in a video poker game, allows the player to play as many free virtual hands of video poker he can play within a certain time frame without wagering additional credits for the subsequent hands. Virtual is defined as being on or simulated on is computer or computer network and visually displayed on a video display.

BACKGROUND

For many years video poker has been a standard game that individuals would play in the casinos to provide individual entertainment by playing virtual cards and comparing a final hand to a predetermined pay scale. Players are able to play this type of poker on their own, make their own decisions, and play at their own speed. To many people of all ages, standard video poker has become very predictable and boring. There has been a need to provide new and interesting video poker games which offer players more entertainment and excitement by adding options and variations to the standard game of video poker. A number of video poker games base been released over the past several years which have dramatically increased the popularity of video poker. With more players visiting casinos and new casinos being built across the country, more interesting and exciting video poker options are needed to satisfy the players. Video poker needs to continue to evolve in order to provide the gaming industry with the tools to satisfy the customers.

SUMMARY OF THE INVENTION

This invention relates to a method of playing video poker wherein an additional virtual bonus card, called a lightning bonus card, is added to a standard deck of virtual cards and may randomly be dealt into the opening five card hand of a video, poker game.

Upon receiving a randomly dealt lightning bonus card in the opening deal of a video poker game, the player is awarded the opportunity to play as many hands of video poker during a specific amount of time without wagering additional credits for each subsequent hand following the receiving of the lightning bonus card.

The lightning bonus card is an additional card that is added to the standard deck of 52 virtual cards and may only show up on the deal of the first five cards in a hand of video poker. If the lightning bonus card does not show up in the initial deal of five cards, it is removed from the deck of cards by the CPU and the player continues to play the hand of video poker by holding and discarding the cards of his choice. All wins are paid out in the form of credits to the player according to a predetermined pay scale.

The lightning bonus card is a special virtual card that always the player to play n number of hands of video poker in m number of seconds without using additional credits in the game. In this particular embodiment of the game, when a player receives a lightning bonus card in the initial five card deals, the player is awarded 30 seconds to play as many virtual hands as possible without losing credits from the credit meter. In other embodiments, the number of seconds may be adjusted higher or lower to provide a fair balance between the player and the company that is producing the game in order to make it profitable to the casinos and alluring to the player. In addition, this embodiment of the game also features a multiplier which happens when a player is in the lightning bonus and receives another lightning bonus card, thus multiplying each of the winnings by two. If yet another lightning bonus card is dealt within the lightning bonus round, the multiplier would increase to three. This process continues as there is no limit on the number of multipliers the player can create from receiving the virtual lightning bonus card. The addition of the multipliers encourages players to play the game as fast as possible in order to increase the chances of being dealt a lightning bonus card. Being able to play video poker fast makes this an appealing game to the companies that manufacture the game and to the casinos that put the game out on the gaming floor.

A typical game of lightning poker comprises the following steps:

A player initiates the game play by placing a predetermined wager on the opening deal of five virtual cards. The opportunity to be dealt a lightning bonus card will require the player to wager an additional amount in order to make the lightning bonus active in the current game. Typically, the extra wager may be one or two credits in addition to the standard amount needed to initiate the game.

The player pushes or touches the deal button and the CPU sends a signal to a random number generator to generate five random numbers. Each number is assigned to a specific card in the virtual deck of cards, including a number for the lightning bonus card. The random number generator sends the signal back to the CPU with the numbers corresponding to each card and displays the cards on the display device for the player to see. If the lightning bonus card does not appear in the virtual five card hand, the player surrenders the extra wager required to have the opportunity to be dealt the lightning bonus card, and a standard game of poker ensues. The player may hold and discard any card or cards in the hand and the final hand will be compared to a predetermined pay scale to award winning credits to the player. In the case of a win, the credits will be added to the credit meter and the player is ready for the next game.

If the CPU sends a signal to the random number generator to generate five random numbers and one of the numbers returned to the CPU is the lightning bonus card, a lightning bonus card will be dealt to the player in the virtual five card hand, thus initiating the lightning bonus. The bonus card will be removed from the virtual hand and placed on the video display to show a countdown clock with m seconds and the final cards are dealt into the virtual hand to complete a virtual beginning five card hand. The player now has m number of seconds to play as many hands of video poker as possible without wagering any additional credits for the subsequent virtual hands. The countdown clock continues to countdown to zero and once it reaches zero, the lightning bonus will end. The faster the player can play each virtual hand, the more likelihood they will have of winning during the lightning bonus period.

During the lightning bonus period, them is a possibility of the lightning bonus card appearing again in the initial virtual five card opening hand. This will result in the lightning bonus card being removed from the hand and placed on the video display to show an additional clock with m seconds right next to the original clock countdown that was triggered. The player will now two countdown clocks on the video display with m seconds showing in each clock. The first clock will freeze the seconds on it and the new clock will begin the countdown. Since this is the second lightning bonus card and the player is in the bonus already, the player will get a new clock, have all wins multiplied by two and no credits used during the lightning bonus. Furthermore, if another lightning bonus card is dealt to the player, the first two countdown clocks will freeze, a third countdown clock will appear and all wins will be multiplied by three. There is no limit to the limit to the lightning bonus. It is conceivable for a player to have any number of countdown clocks and multipliers while playing the game. The multiplier can be two or three as illustrated above or be random ranging from two to 10 or more. The multipliers do not have to he sequential as shown above. If the third countdown clock reaches zero it will disappear, all wins will go being multiplied by two and the second countdown clock will take over. If the second countdown clock reaches zero, wins will go back to the original pay scale, and the first clock will continue to countdown where it left off when the player received the second lightning bonus card in the hand. If the first clock reaches a countdown of zero, the lightning bonus round will end. As noted above, the multipliers can be random and do not have to be sequential.

DETAILED DESCRIPTION OF THE DRAWINGS

Figure 1:
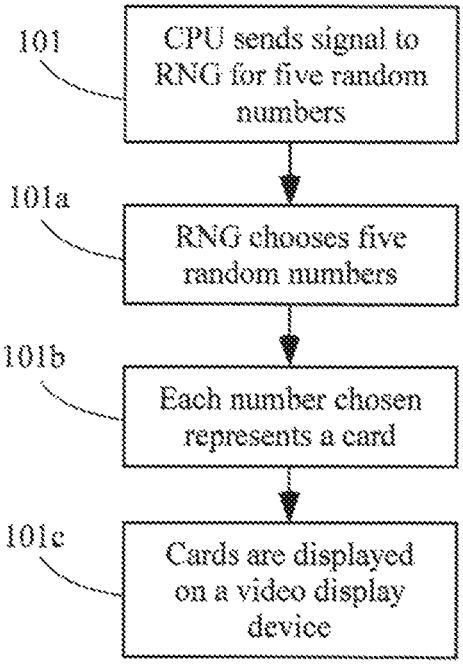
FIG. 1 shows the process that can be used to include the lightning poker card into a virtual hand of video poker.
Figure 7:
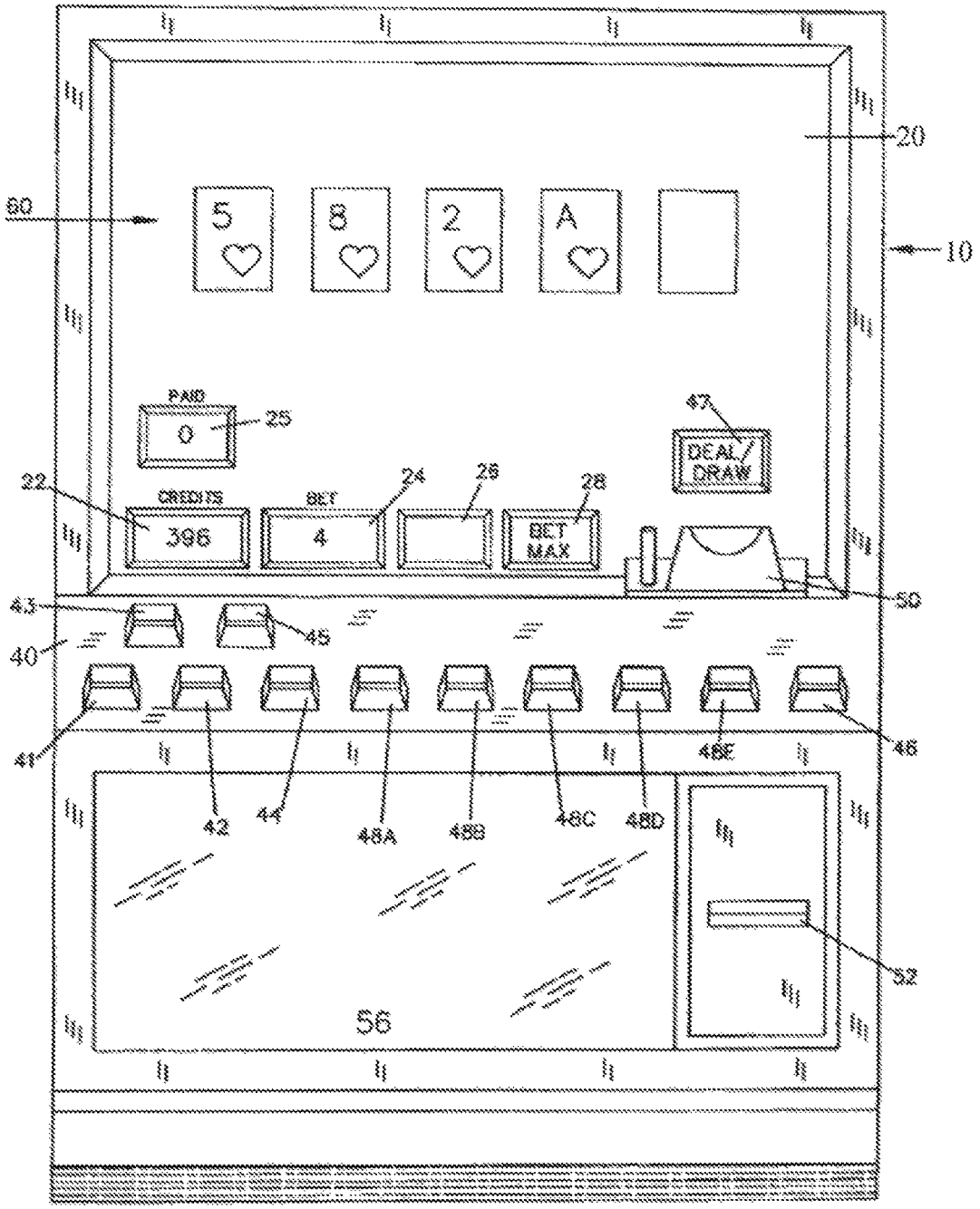
FIG. 7 shows a typical gaming console.

FIG. 1 a illustrates a process that can be used to include a lightning bonus card (not shown) into virtual hand of video poker (not shown). The lightning bonus card is included in a standard virtual deck of 52 cards. When the player pushes or touches a button on a gaming console (an example is shown in FIG. 7) to deal the cards into the virtual five card hand, the CPU, or central processing unit, sends a signal to the RNG, or random number generator to randomly select five numbers 101. The RNS selects the five numbers 101*a*, each number representing a virtual card within the deck of cards including a number for the lightning bonus card 101*b*, and displays them on a video device forming an initial, random virtual five card video poker hand 101*c*.

Figure 1A:
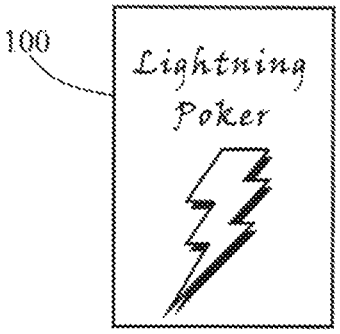
FIG. 1A shows an example of the virtual lightning bonus card.

FIG. 1A shows an example of the lightning bonus card 100.

Figure 2:
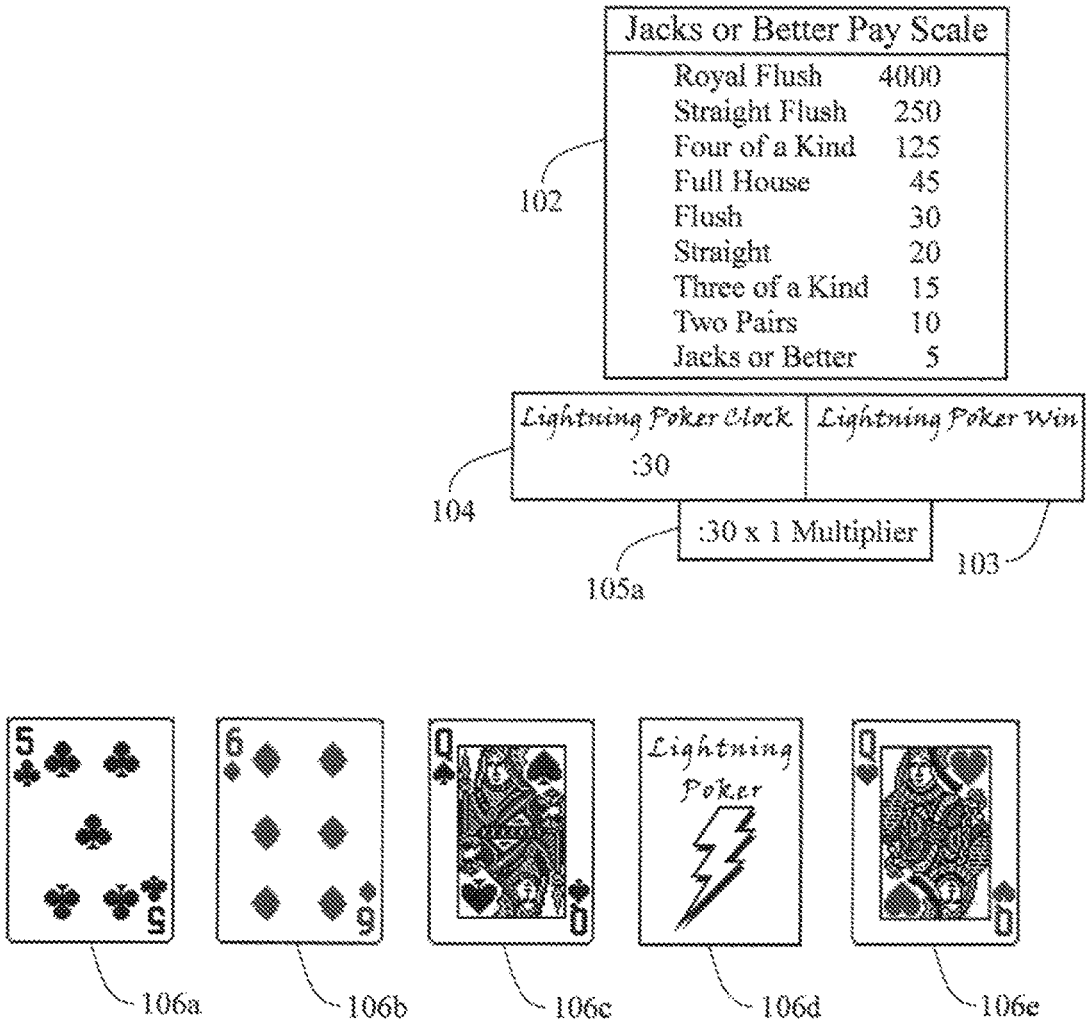
FIG. 2 shows an opening deal which contains a lightning bonus card and the amount of time on the first countdown lightning poker clock and a multiplier of one.

FIG. 2 illustrates an opening hand of randomly dealt virtual cards on the active game area, a predetermined pay scale 102, a lightning poker win column 103 to display the winning credits, an overall lightning poker countdown clock 104 showing 30 seconds on it, a current lightning poker countdown clock showing 30 seconds and a multiplier of one earned 105*a*, and the five initial virtual cards dealt into the five card hand, five of clubs 106*a*, six of diamonds 106*b*, queen of spades 106*c*, lightning bonus card 106*d*, and the queen of hearts 106*e*. Since the lightning poker card 106*d* was virtually dealt to the player on the deal, the player now is in the lightning poker bonus mode or period. The player will now get thirty seconds on the lightning poker countdown clock 104 and have all the winnings multiplied by one. The player will play for thirty seconds, as many virtual hands as possible, without losing any credits he has earned prior to being dealt the lightning poker card 106*d*. The lightning poker card 106*d* is removed from the deal and a virtual replacement card is dealt in its' place prior to the lightning poker countdown clock 104 beginning.

Figure 3:
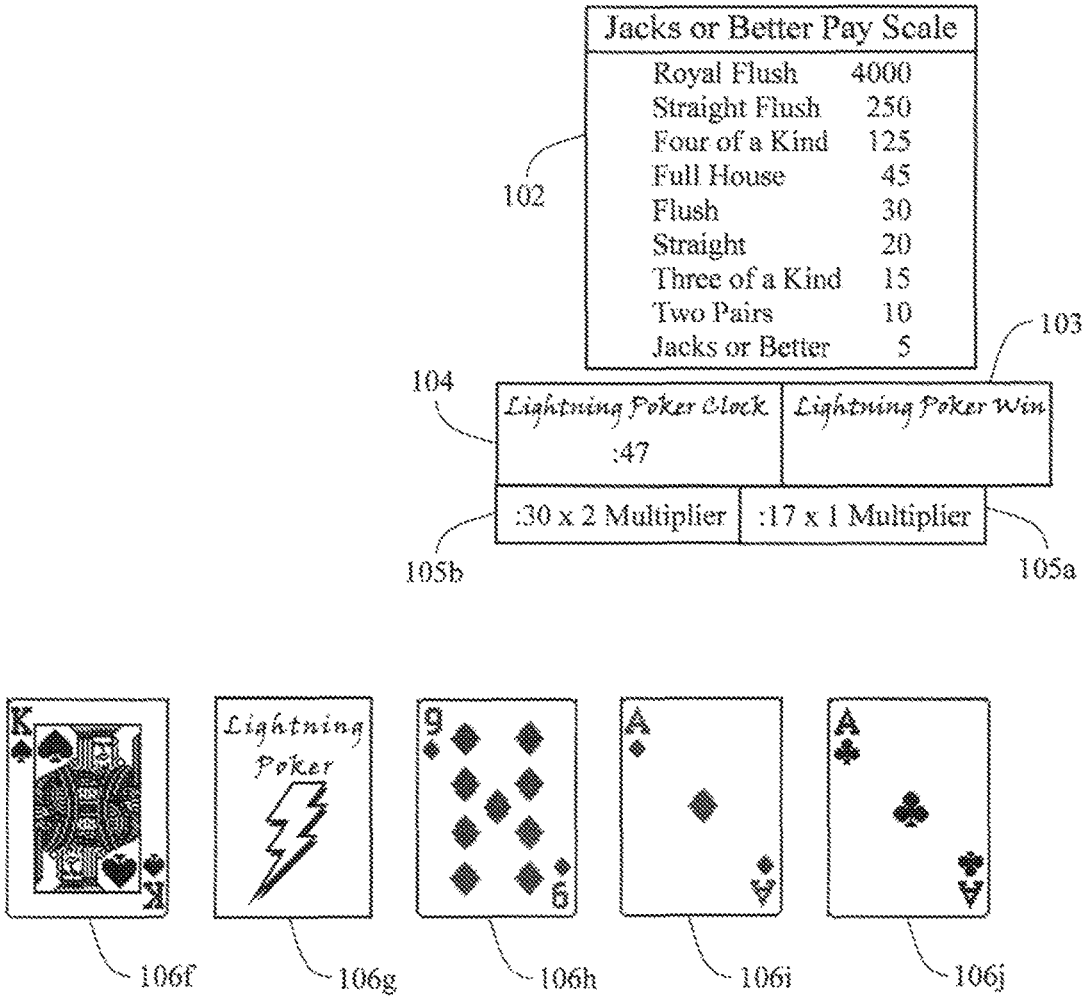
FIG. 3 shows a second lightning bonus card being dealt virtually while the player is currently in the lightning bonus and the amount of time on the first and second countdown lightning poker clocks and the corresponding multipliers.

FIG. 3 illustrates an opening deal of five random virtual cards on the active game area while within the lightning bonus mode, a predetermined pay scale 102 showing the entire pay scale being multiplied by two for all winning hands 105*b*, a lightning poker win column 103 to display the winning credits, an overall lightning poker countdown clock 104 showing 47 seconds on it, a current lightning poker countdown clock 105*b* with 30 seconds and the now current multiplier of two, the previous lightning poker countdown clock 105*a* with 17 seconds and a multiplier of one, and the five initial cards dealt into the virtual five card hand, king of spades 106*f*, lightning poker card 106*g*, nine of diamonds 106*h*, ace of diamonds 106*i*, and the ace of clubs 106*j*. Since the player is currently an lightning bonus mode and another lightning poker card 106*g* was dealt into the hand during the countdown, the player now will get another lightning poker countdown clock 105*b* with 30 seconds on it, in addition to the time that was left on the first lightning poker countdown clock 105*a*. Upon getting the second lightning poker card 106*g* in the hand, the player will now have all wins within the 30 second clock multiplied by two. The player now has 30 seconds with wins all multiplied by two and 17 seconds with wins all multiplied by one for a total lightning bonus lasting a total of 47 seconds.

Figure 4:
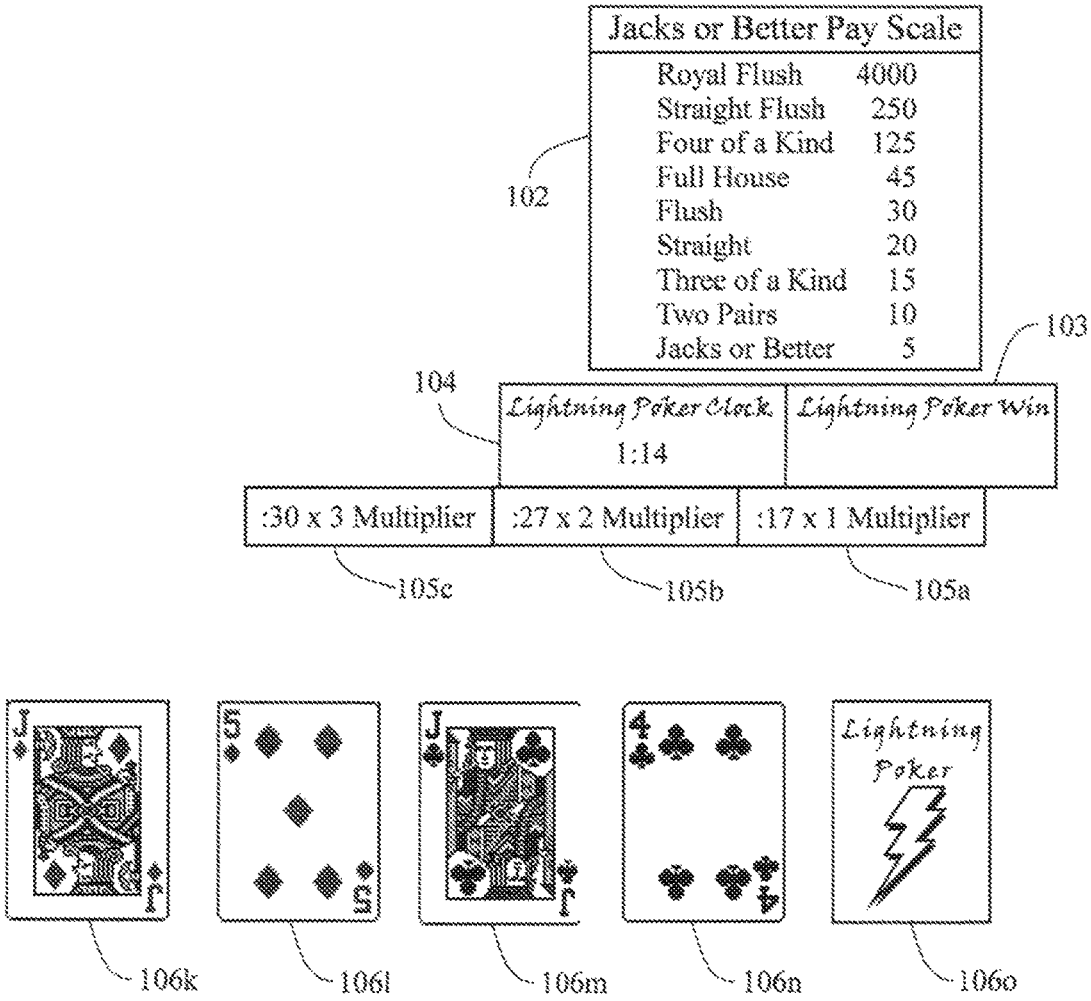
FIG. 4 shows a third lightning bonus card being dealt while the player is currently in the lightning bonus and the amount of time on the first, second, and third countdown lightning poker clocks and the corresponding multipliers.

FIG. 4 illustrates an opening deal of five virtual random cards on the active game area while in lightning bonus mode, a predetermined pay scale 102 showing the entire pay scale being: multiplied by three 105*c* for all winning hands, a lightning poker win column 103 to display the winning credits, an overall lightning poker countdown clock 104 showing 1 minute and 14 seconds on it, a current lightning poker countdown clock 105*c* with 30 seconds and the now current multiplier of three, the previous lightning poker countdown clock 105*b* with 27 seconds and a multiplier of two, and the initial lightning poker countdown clock 105*a* with 17 seconds and a multiplier of one, and the five initial cards dealt into the virtual five card hand, jack of diamonds 106*k*, five of diamonds 106*l*, jack of clubs 106*m*, four of clubs 106*n*, and the lightning poker card 106*o*. Since the player is currently in the second lightning bonus and a third lightning poker card was dealt into the hand during the countdown, the player will now get a third lightning poker countdown clock 105*c* with 30 seconds on it, in addition to the time that was left on the first and second lightning poker countdown clocks 105*b* and 105*a*. Upon getting the third lightning poker card 106*o* in the hand, the player will now have all wins within the 30 second clock multiplied by three. The process of adding additional lightning poker countdown clocks and multipliers continue as long as the virtual lightning poker card is dealt into the hand with time remaining on the current clock 105*c*. If at any time the current lightning poker countdown clock reaches zero, the clock is removed along with the current multiplier and the previous clock will take over the countdown with the multiplier from the point where it was paused when the player received a lightning poker card while in the lightning poker bonus period. If all lightning poker countdown clocks reach zero, the lightning poker bonus is over and the player will need to wager credits in order to continue playing the game.

Figure 5:
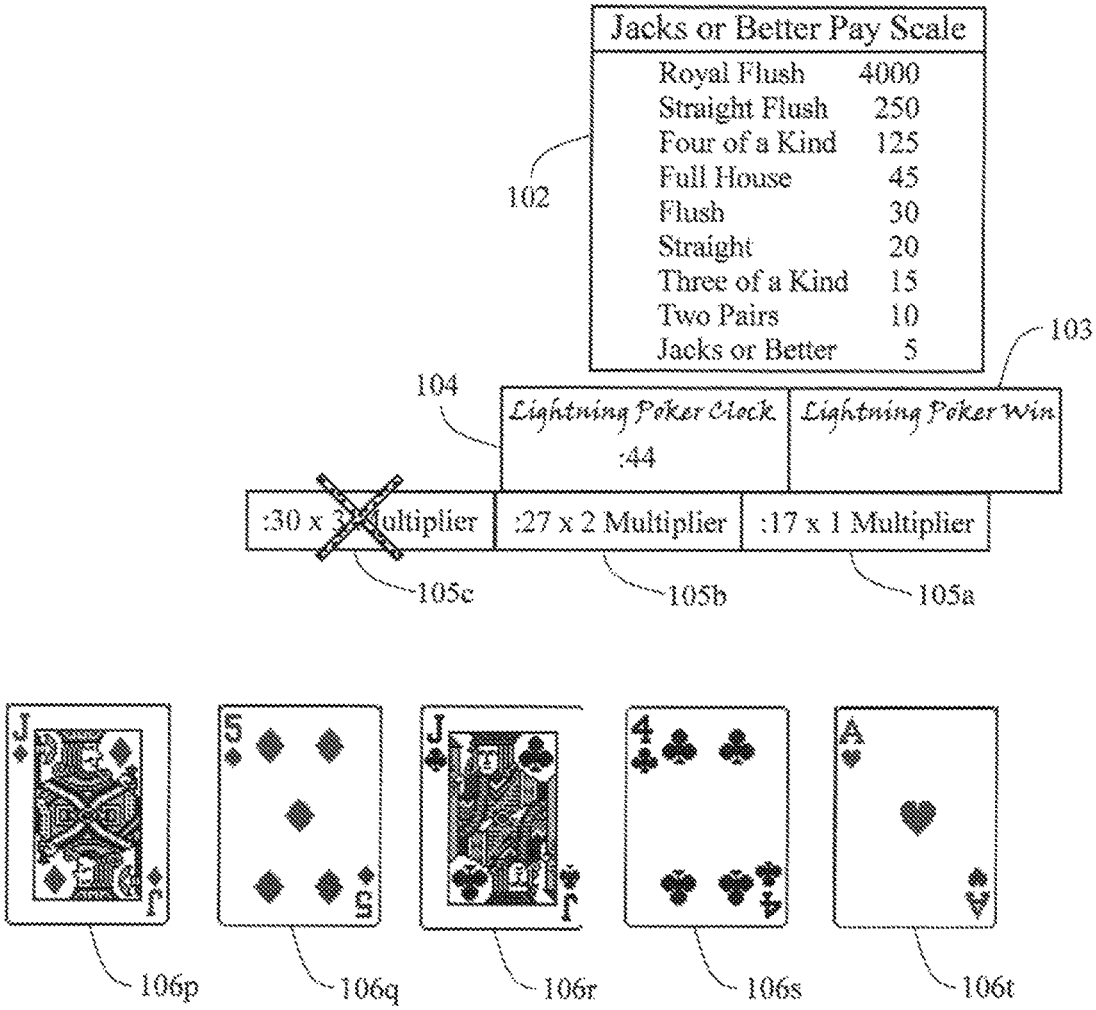
FIG. 5 shows the third lightning bonus card clock and multiplier expiring and dropping off of the current game.

FIG. 5 illustrate how a lightning poker countdown clock 105*c* reaches zero and is removed from the pending game. FIG. 5 shows the active gaming area while the player is currently in lightning poker bonus mode, a predetermined pay scale 102., a lightning poker win column 103 to display the winning credits, an overall lightning poker countdown clock 104 showing 44 seconds, a currently expired lightning poker countdown clock 105*c* reaching zero and being removed from the game, a now active lightning poker countdown clock 105*b* showing 27 seconds and a multiplier of two, and a lightning poker countdown clock 105*a* showing 17 second and a multiplier of one. The player has been virtually dealt the jack of diamonds 106*p*, five of diamonds 106*q*, jack of clubs 106*r*, four of clubs 106*s*, and ace of hearts 106*t*. Since the player did not receive a lightning poker card while in the current lightning poker countdown clock 105*c*, the clock has expired and is removed from the game, thus returning the player to the previous lightning poker countdown clock and multiplier 105*b* and 105*a*. The player may at any time receive another lightning poker card to gain additional clocks, but each time they expire they are removed from the hand.

Figure 5A:
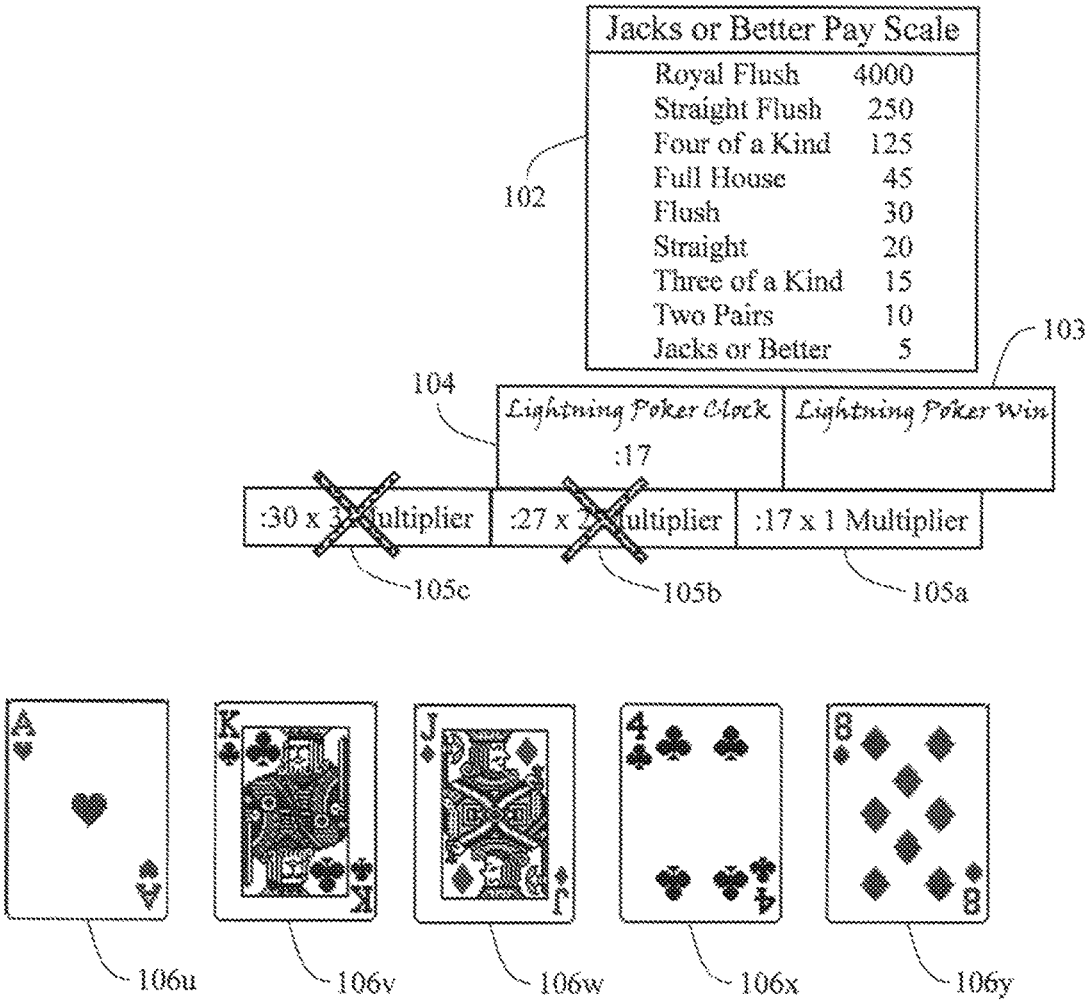
FIG. 5A shows the second lightning bonus card clock and multiplier expiring and dropping off of the current game.

FIG. 5A also illustrates how a lightning poker countdown clock reaches zero and is removed from the pending game. FIG. 5A shows the active gaming area while the player is currently in the lightning poker bonus mode, a predetermined pay scale 102, a lightning poker win column 103 to display the winning credits, an overall lightning poker countdown clock 104 showing 17 seconds, two currently expired lightning poker countdown clocks reaching zero and being removed from the game 105*c* and 105*b*, a now active lightning poker countdown clock 105*a* showing 17 seconds and a multiplier of one. The player has been dealt the ace of hearts 106*u*, king of clubs 106*v*, jack of diamonds 106*w*, four of clubs 106*x*, and the eight of diamonds 106*y*. Since the player did not receive a lightning poker card while in the consent lightning poker countdown clock 105*a*, the clocks 105*c* and 105*b*, are removed from the game, thus returning the player to the previous lightning poker countdown clock and multiplier. In this situation, the player is playing within the final lightning poker countdown clock.

Figure 5B:
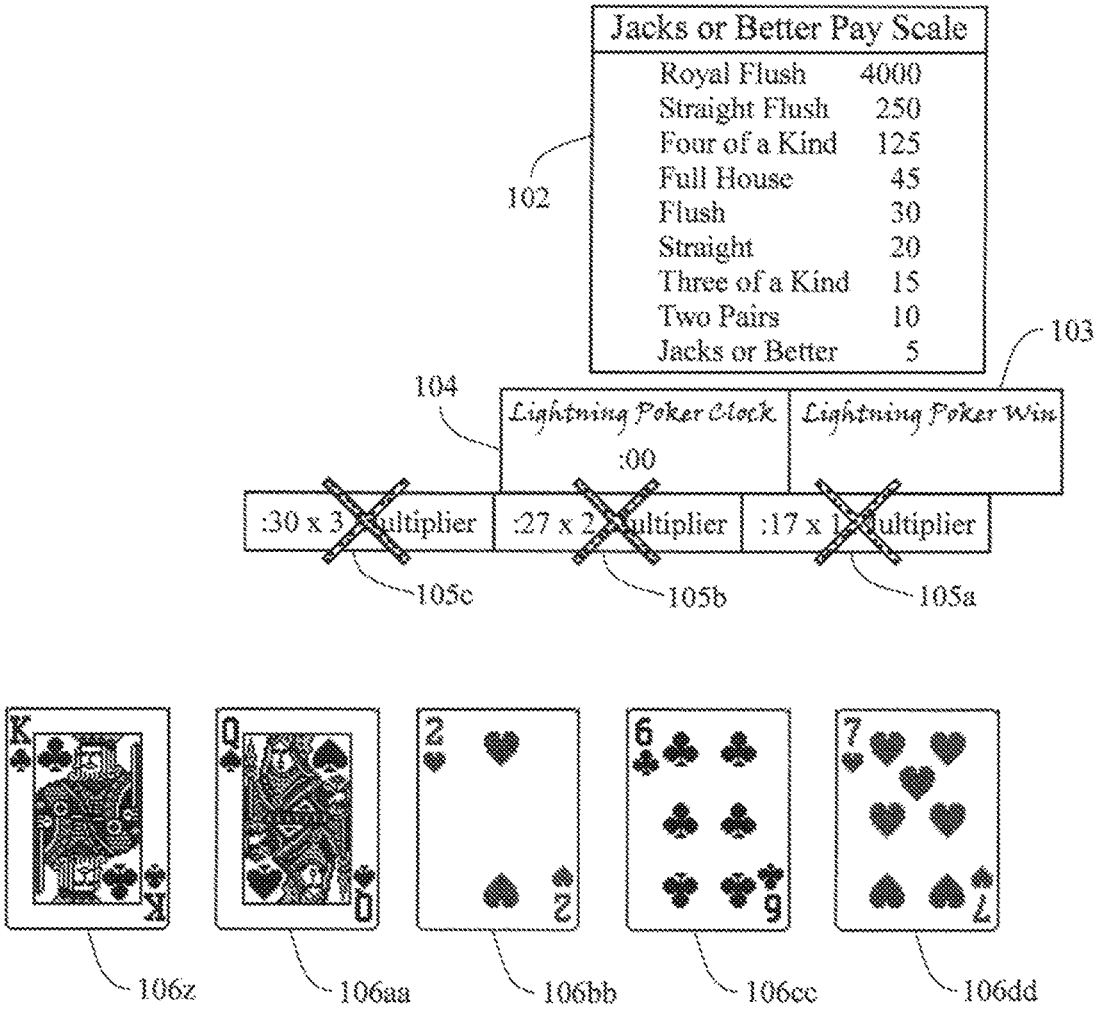
FIG. 5B shows the first lightning bonus card clock and multiplier expiring and dropping off thus ending the lightning poker bonus.

FIG. 5B illustrates how the lightning poker bonus comes to an end. FIG. 5B shows the active gaming area with a predetermined pay scale 102, a lightning poker win column 103 to display the winning credits, an overall lightning poker bonus countdown clock 104 showing zero seconds, three expired lightning poker countdown clocks 105*c*, 105*b*, and now 105*a*. The player was virtually dealt a king of clubs 106*z*, queen of spades 106*aa*, two of hearts 106*bb*, six of clubs 106*cc* and seven of hearts 106*dd*. Since the player did not receive a lightning poker card while in the current lightning poker countdown clock, the lightning poker countdown clocks 105*c*, 105*b*, and now 105*a* have all reached zero and are removed from the game, thus ending the lightning bonus. All wins are added to the player's credit meter 103 and the next hand the player plays will require a wager since all of the lightning bonus clocks have expired and have been removed from the pending game. Each time the player gets into the lightning poker bonus, a lightning poker countdown clock and a multiplier is added to the game and each time the countdown clock reaches zero it is removed from the game.

Figure 6A:
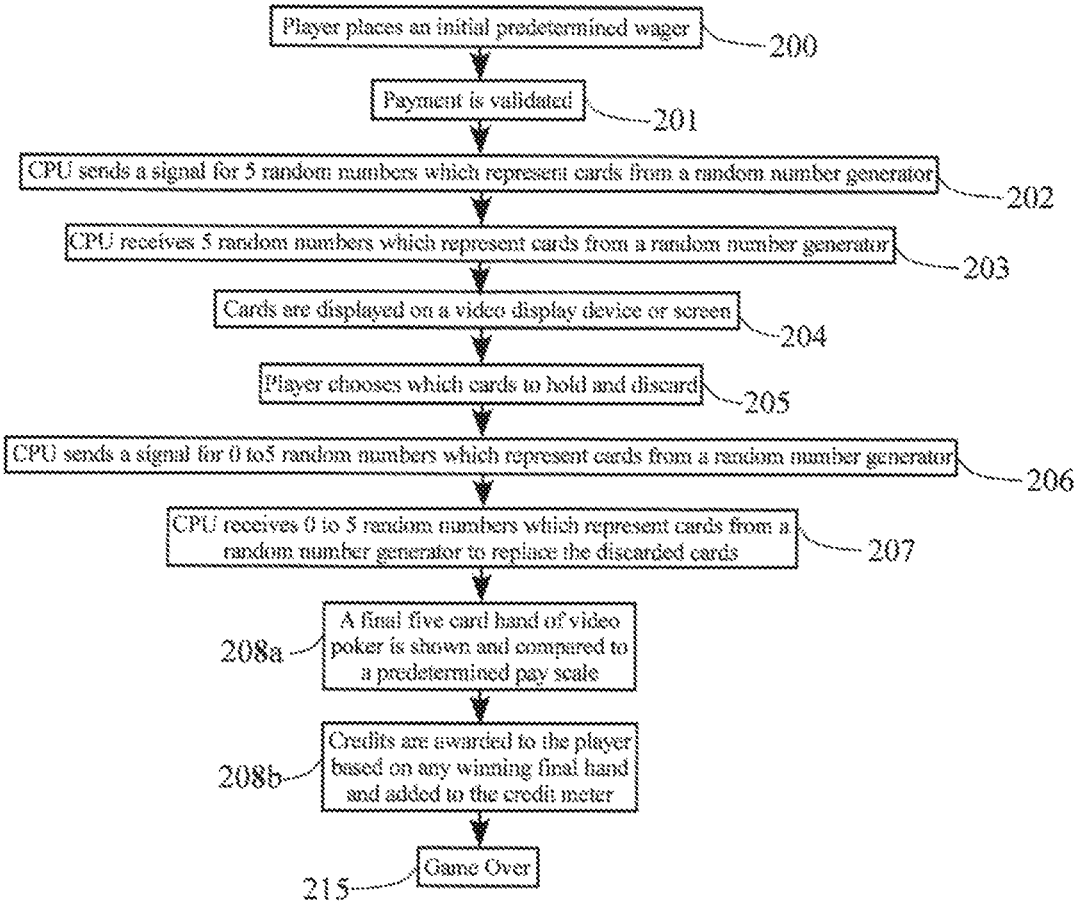
FIG. 6A shows a block diagram of game play without the lightning bonus card option.

FIG. 6A is a block diagram of typical game play without the lightning bonus card bonus option. A player places a predetermined wager 200. The computer validates the payment 201 and sends a signal to a random number generator (RNG) to send out five random numbers that represent virtual cards, including a number to represent the virtual lightning bonus card 202. The computer receives the random numbers 203 that represent virtual cards, including a number to represent the lightning bonus card and displays the representative cards thee up on the video display device or screen and arranges them in a row of five 204. The player chooses zero to five virtual cards to hold in the main hand 205. The computer sends a signal to the random number generator to send out zero to five random numbers that represent virtual cards to replace the discarded cards 206. The computer receives the random numbers and completes the main hand 207. A final five card hand of video poker is displayed on the screen and compared to a predetermined pay scale 208*a*. Credits are awarded to the player based on any winning final hand and added to the credit meter 208*b*. Game play has now ended 215.

Figure 6B:
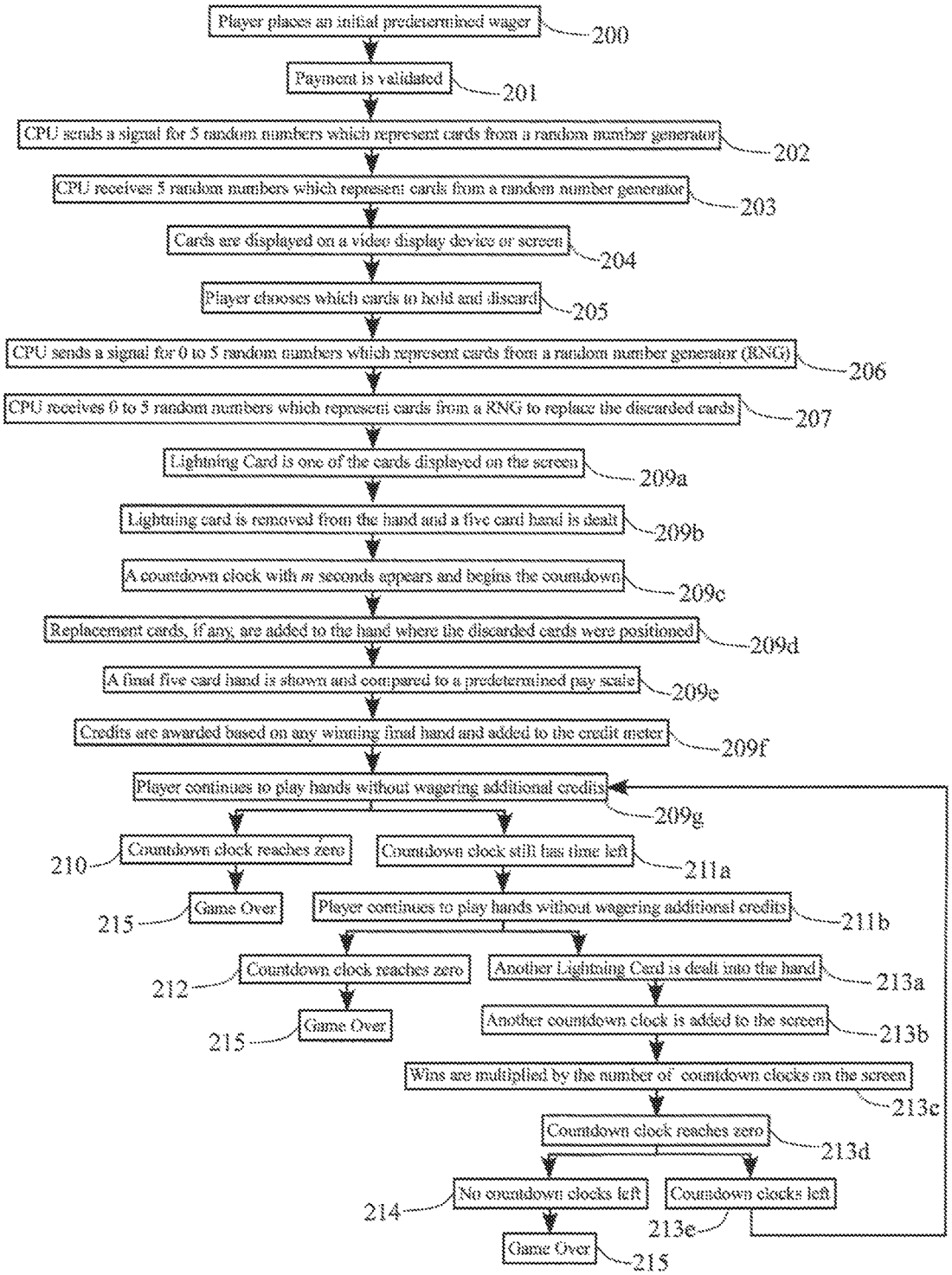
FIG. 6B shows a block diagram of game play with the lightning bonus card.

FIG. 6B is a block diagram of typical game play with the lightning bonus card bonus option. A player places a predetermined wager on the main hand and an additional predetermined wager to activate the possibility of obtaining a lightning bonus card 200. The computer validates the payment 201 and sends a signal to a random number generator to send out five random numbers that represent virtual cards, including a number to represent the lightning bonus card 202. The computer receives the random numbers 203 that represent virtual cards, including a number to represent the lightning, bonus card and displays the representative cards face up on the video display device or screen and arranges them in a row of five 204. The player chooses zero to five cards to hold in the main hand 205. The computer sends a signal to the random number generator to send out zero to five random numbers that represent virtual cards to replace the discarded virtual cards 206. The computer receives the random numbers and completes the main hand 207. Since the player received a lightning bonus card on the deal 209*a*, lightning bonus card is removed and another five card and is dealt 209*b*. The player is awarded m number of seconds to play as many virtual hands of video poker as possible without wagering any additional credits 209*c*. Virtual replacement cards, of any, are added to the hand where the discarded cards were positioned 209*d*. A final virtual five card hand of video poker is shown and compared to a predetermined pay scale 209*e*. Credits are awarded to the player based on any winning final hand and added to the credit meter 209*f*. The player continues to play hands without wagering additional credits 209*g*. This "free-play" lasts until the lightning poker clock reaches zero seconds 210. When the countdown clock reaches zero, game play ends 215.

If the countdown clock still has time on it 211*a*, the player continues to play hands without wagering additional credits 211*b*. This "free-play" lasts until the lightning poker clock reaches zero seconds 212. When the countdown clock reaches zero, game play ends 215.

If the player receives another lightning bonus card during the "free-play" session 213*a*, an additional clock with n seconds is added to the game and creates a multiplier which will multiply all the wins achieved during that time frame by two 213*b*. Each additional dealt lightning bonus card adds another clock and multiplier to the game 213*c*. Once each lightning poker clock reaches zero 213*d*, that clock and multiplier is removed from the game and the preceding clock and multiplier is active and the player continues to play hands without wagering additional credits 209*g*. This process continues until all the clocks have expired, thus completing the lightning bonus 214 and ending game play 215. It is possible within the game play for the player to have any number of clocks and multipliers depending on how often the lightning bonus card is dealt into the hand on the deal of each game.

FIG. 7 shows a typical electronic video gaming machine 10 that is configured to provide a player apparatus for a poker game such as the method and system of the present invention. The electronic video gaming machine 10 includes a conventional coin acceptor 50 into which the player can insert coins or gaming tokens and a bill acceptor 52 mounted to the gaming machine 10 and into which the player can insert paper currency or cash in (ticket in)—cash out (ticket out) (TITO). The use of coins, tokens, paper currency, or TITO, is one mechanism by which the player may wager on the poker hands the player wishes to play. Also, in the electronic video gaming machine 10, a credit meter display 22 is provided to show the amount of credits that the player has accrued on the gaming machine 10, either by inserting coins, tokens, paper currency, TITO, or from winning plays achieved by the player. Whenever the player makes a wager, the amount of the wager is subtracted from the credit meter display 22. Whenever the player achieves a winning play during the play of the game, the amount of the winning play is added to the credit meter display 22.

A conventional payout hopper is also located on the interior of the gaming machine and is used to dispense coins or tokens to the player into a payout tray 56 when the player wishes to collect any winning amounts the player has accrued. Other suitable and conventional payout mechanisms can be used, such as a ticket printer (TITO) or other cashless payout devices.

The gaming machine 10 also includes a video semen display 20 of any suitable size or type upon which representations of playing cards are displayed. The video screen display may comprise any display technology including CRT (cathode ray tube), DC or AC gas discharge, LED (light emitting diode), OLED (organic light emitting diode), and LCD (liquid crystal display). A first hand is shown at location 60. This hand would preferably have five card locations preferably from left to right in a horizontal row, although other manners of displaying multiple hands may be used within other embodiments of the current invention. The video screen display 20 also contains a location at which the amount wagered on each hand is shown, for example, "bet"24. In this illustration, the player has bet 4 credits.

A button panel 40 is also provided on the gaming machine 10 with buttons mounted on the button panel 40 to be used by the player to control the operation of the gaming machine 10. Any suitable number or configuration of the buttons on the button panel can be used and, alternatively, conventional touch screen technology can be used for any or all of the buttons mounted on the button panel.

A typical button arrangement is shown on the button panel 40 in FIG. 7. A "BET ONE" button 42 is provided to allow the player to wager one credit at a time. A "BET MAX" button 44 is provided to allow the player to wager the maximum amount of credits permitted by the configuration of the gaming machine 10. Any number of credits can be set as the minimum or maximum amount that it is possible to wager on each hand. Typically, five credits may be the maximum number of credits for any particular hand. Alternatively, a BET ONE location 26 and a BET MAX location 28 can be provided on the video screen 20 to allow the player to wager by using conventional touch screen technology. A conventional "DEAL/DRAW" button 46 is also provided on the button panel 40 which is used by the player to activate the initial deal of the cards at the stage of the method of play or the dealing of replacement cards at the draw stage of the method of play as is appropriate. Similarly, a DEAL/DRAW location 47 can be provided on the video screen 20 to allow the player to select either the deal step or draw step by using conventional touch screen technology. The button panel 40 is also provided with five "CARD" buttons 48A, 48B, 48C, 48D, and 48E associated with each horizontal card location on the video screen display: a card button 48A is associated with the left most card location, card button 48B is associated with the second from the left card location, card button 48C is associated with the middle card location, card button 48D is associated with the second from the right card location and card button 48E is associated with the right most card location. Each card button is preferably aligned below the card locations so that the player can easily associate the appropriate card button with the appropriate card location. The method of play of the various versions of the present invention will now be described. After the player has inserted an appropriate amount of coins, tokens, paper currency, or TITO to add a sufficient amount of credits on the credit display meter 22, the player makes his initial wager. The player may press the BET ONE button 42 one or more times to bet in single increments or the player may merely press the "BET MAX" button 44 and the maximum number of credits are applied, for example, five credits would be wagered. The player can also use the touch screen locations to make his wager as described above.

To play the poker game, the player establishes a pool of credits, sets the wager, deals the cards, chooses which cards to hold and discard, draws replacement cards, and collects credits for winning card combinations.

BUTTONS

In one embodiment, a set of buttons are mounted on the button panel 40 and are used by the player to control functions of the poker game: BET ONE 42, BET MAX 44, DEAL/DRAW 46, Help 43, Pay Table 45, and Cash Out 41. Any or all of these control buttons may be displayed on the video display 20 and/or buttons electronically connected to the gaming device. If necessary, any number of buttons may be added to further facilitate control of the game, such as HOLD buttons to "hold" the cards shown on video display.

METERS

In one embodiment, meters are shown on the video display screen to display the salient information for the game: Credit meter 22, Bet meter 24, and Paid meter 25. The Credits meter 22 displays the total number of credits remaining in the credit pool; the Bet meter 24 displays the amount wagered on the current, previous, and/or upcoming poker hand and is associated with the Bet one 42 and Bet max 44 buttons; and the Paid meter 25 displays the amount of credits won on current or previous poker hand.

CREDIT POOL

In one embodiment, the player deposits coins, tokens, paper currency, TITO, credit cards, debit cards, or other forms of physical and/or electronic currency into the con acceptor slot 50 or a paper currency bill acceptor 52 to establish a pool of credits. The amount of this common pool of credits is displayed to the player on the Credit meter 22. The pool of credits increases and decreases according to the player's wins or losses and may be supplemented, if necessary, by the player by additional deposits of coins, tokens, paper currency, TITO, credit cards, debit cards, or other forms of physical and/or electronic currency.

SET THE WAGER

In one embodiment, the player sets the value of the wager by using the Bet One 42 and Bet Max 44 buttons. The bet may range between one credit and n credits, with n equal to a predetermined maximum or set by the current value of the credit pool. The typical video poker gaming machine uses a five credit maximum wager.

DECK OF CARDS

In one embodiment, each card dealt is selected from one or more suitable decks of cards such as one or more fitly-two card traditional decks (i.e. the traditional four suits of Spades, Hearts, Diamonds, Clubs, with thirteen ranks in each suit of two, three, four, five, six, seven, eight, nine, ten, Jack, Queen, King, and Ace) plus bonus cards that may be added before or after the deal or draw.

DEAL OF CARDS

In one embodiment, the player causes the machine 10 to deal the cards by pressing the Deal button 46. Once the Deal button 46 is pressed, the wager is final and non-refundable. For each deal, the machine 10 randomly displays five cards face-up in the five card positions. In a single standard deck embodiment, a displayed card is removed from the deck and may not be dealt again during that game. Typically, only the remaining non-dealt cards in the deck are used to replace a dealt card.

HOLD AND DISCARD

In one embodiment, the player selects which cards to hold and which cards to discard using the buttons on the machine 10 or touching the cards on the video display 20 (i.e. pressing a button or touching card will "hold" the card). Alternatively, the machine 10 may automatically select cards to hold and/or discard and then allow the player, to override the selections by using the buttons or touching the display screen 20. This may be useful in training mode.

WINNING CARD COMBINATIONS

In one embodiment, the player is paid for predetermined winning combinations of virtual cards that appear in the final hand. Each winning combination pay the amount indicated on the predetermined pay scale times the total amount wagered on that hand. Furthermore, the value of a winning card combination may be enhanced by the appearance of one or more lightning bonus cards during the initial deal; all enhanced values are also reflected on the predetermined pay scale.

TRIPLE PLAY

In one embodiment, this invention is used in a multiple hand video poker game such as Triple Play which allows a player to play more than one hand of video poker at a time. Triple Play typically involves playing three hands at a time, but multiple hands up to 100 hands or more can be played. Triple Play is disclosed in U.S. Pat. Nos. 5,823,873 (Moody), 6,120,378 (Moody et al.), 6,638,163 (Moody), 7,247,091 (Moody), and 8,439,737 (Moody), all incorporated herein by reference.

OTHER EMBODIMENTS

In another embodiment, one or more lightning bonus cards is added to the hand on the deal to replace discarded cards.

In another embodiment, n additional lightning bonus poker hands are generated within a time period t the bonus hands being randomly triggered with a CPU and/or RNG without the use of a lightning bonus card.

In another embodiment, n additional lightning bonus poker hands are generated within a time period t, the bonus hands being triggered by a predetermined event such as a winning, poker hand. Examples include, not by way of limitation, three of a kind, straight, flush, full house, four of a kind, straight flush, and so forth.

SUMMARY

The foregoing description of the various embodiments of the invention has been presented for purposes of illustration and description. It is not intended to be exhaustive or to limit the invention to the precise forms disclosed. Obvious modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims to be interpreted in accordance with the breadth to which they are fairly, legally, and equitably entitled.

The invention claimed is:

1. An electronic gaming machine console comprising:

a. a computer;

b. a random number generator;

c. a video display device;

d. a deck of cards containing at least one additional lightning bonus card;

e. a button panel for control of the operations of the gaming machine, said operations including;

i. the placing of a wager;

ii. the generating of cards in a poker hand randomly generated from the deck of cards by the random number generator, said poker hand being dealt and displayed by the computer on the video display device;

iii. the holding and discarding of cards in the poker hand and displayed on the video display device by the computer;

iv. dealing additional cards to replace discarded cards, said dealt cards including a lightning bonus card;

f. said lightning bonus card providing for n additional poker hands to be generated within a time period each winning poker hand generated within the time period t receiving a payout based on the wager.

2. The gaming machine console of claim 1 wherein the time period t is 30 seconds.

3. The gaming machine console of claim 1 wherein an additional lightning bonus card is dealt in one of the n poker hands dealt within the time period t, said additional lightning bonus card adding additional time to the time period t.

4. The gaming machine console of claim 1 wherein each lightning bonus card contains a winning payout multiplier, each multiplier varying from lightning bonus card to lightning bonus card.

5. The gaming machine console of claim 1 is wherein each lightning bonus card contains a random winning payout multiplier that is two or more.

6. The gaming machine console of claim 1 is wherein each lightning bonus card contains a random winning payout multiplier that ranges from two to 15.

7. The gaming machine console of claim 4 wherein each multiplier is random and is two or more.

8. The gaming machine console of claim 4 wherein each multiplier is random and ranges from two to 15.

* * * * *